US006483476B2

(12) United States Patent
Cox

(10) Patent No.: US 6,483,476 B2
(45) Date of Patent: Nov. 19, 2002

(54) ONE-PIECE YAGI-UDA ANTENNA AND PROCESS FOR MAKING THE SAME

(75) Inventor: Roger A. Cox, Lincoln, NE (US)

(73) Assignee: Telex Communications, Inc., Lincoln, NE (US)

( * ) Notice: Subject to any disclaimer, the term of this patent is extended or adjusted under 35 U.S.C. 154(b) by 0 days.

(21) Appl. No.: 09/732,364

(22) Filed: Dec. 7, 2000

(65) Prior Publication Data

US 2002/0105473 A1 Aug. 8, 2002

(51) Int. Cl.[7] ..... H01Q 21/12
(52) U.S. Cl. ..... 343/815; 343/303; 343/817
(58) Field of Search ..... 343/803, 815, 343/817, 818, 819, 792.5, 834, 872; H01Q 21/12

(56) References Cited

U.S. PATENT DOCUMENTS

| | | | | | |
|---|---|---|---|---|---|
| D209,969 | S | | 1/1968 | Greenberg | D26/14 |
| 3,806,932 | A | * | 4/1974 | Dietrich et al. | 343/854 |
| 3,875,572 | A | * | 4/1975 | Kay | 343/803 |
| 3,928,584 | A | | 12/1975 | Tacussel | 343/735 |
| 4,058,813 | A | | 11/1977 | Risko | 343/786 |
| 4,218,686 | A | * | 8/1980 | Blonder | 343/819 |
| 4,251,818 | A | * | 2/1981 | Lander | 343/819 |
| 4,468,674 | A | * | 8/1984 | Bonder | 343/815 |
| 5,068,672 | A | * | 11/1991 | Onnigian et al. | 343/859 |
| 5,712,643 | A | | 1/1998 | Skladany | 343/700 |
| 5,724,051 | A | | 3/1998 | Mallandt et al. | 343/795 |
| 5,913,549 | A | | 6/1999 | Skladany | 29/600 |
| 5,936,590 | A | | 8/1999 | Funder | 343/795 |
| 6,046,704 | A | | 4/2000 | Lopez | 343/821 |
| 6,057,805 | A | * | 5/2000 | Harrington | 343/792.5 |
| 6,307,524 | B1 | * | 10/2001 | Britain | 343/795 |

FOREIGN PATENT DOCUMENTS

| | | |
|---|---|---|
| EP | 0 048 639 | 7/1982 |

* cited by examiner

*Primary Examiner*—Tho Phan
(74) *Attorney, Agent, or Firm*—Thomte, Mazour & Niebergall; Shane M. Niebergall

(57) ABSTRACT

A one-piece multi-element directional Yagi-Uda antenna comprised of an array of director elements, a reflector element, boom and folded dipole driven element is fabricated from a single piece of conductive material. The method of forming the antenna uses simple, low-cost techniques, such as single and progressive die stamping, punching and forming. The dipole driven element of the antenna is formed by folding the ends of the driven element during the stamping process or in a separate folding step. In an alternative embodiment of the invention, the boom of the antenna array is formed with sufficient length to operatively connect a radome thereto.

8 Claims, 3 Drawing Sheets

ONE-PIECE YAGI-UDA ANTENNA AND PROCESS FOR MAKING THE SAME

BACKGROUND OF THE INVENTION

1. Field of the Invention

The present invention generally relates to antennas. More particularly, the invention relates to Yagi-Uda directional parasitic array antennas at microwave frequencies and low-cost methods for manufacturing the same.

2. Description of the Related Art

"Yagi-Uda" antennas have been successfully used for many years in applications ranging from the reception of television signals, point-to-point communications and certain types of military electronics. The basic Yagi antenna typically comprises a single driven element, usually a half-wave dipole, which is driven from a source of, or which drives a sink of, electromagnetic energy. Certain non-driven or parasitic elements are arrayed with the dipole. These parasitic elements typically include a reflector element on one side of the dipole and one or more director elements on the other side of the dipole. Each of these several elements are usually positioned in spaced relationship along an antenna axis with the director elements extending in what is referred to as the transmission direction from the dipole. The transmission direction is that direction to which electromagnetic energy is to be received. The length of the elements and the distances between them determine the radiating power of the antenna system.

The prior art to the present disclosure is comprised of several different designs of Yagi-type antennas and methods of fabricating the same. In particular, Skladany U.S. Pat. No. 5,913,549 teaches the disposition of a parasitic element array onto a dielectric substrate. Despite the use of low-cost stamping or photo-etching techniques to produce the directors, the Skladany design uses a separate microwave substrate for the placement of the signal phasing lines, feed lines and driven elements. Unfortunately, the use of a separate microwave substrate increases the cost and weight of the antenna. Moreover, the Skladany method is comprised of numerous steps that increase labor costs in the manufacture of the antennas. The Skladany method first requires that the directors be attached to a substrate or circuit board. Then a second circuit board must be attached to the first. Finally, the feed line is connected to the second circuit board. A low-cost method of designing a single-piece, Yagi-type antenna would clearly be beneficial to the art.

Huang U.S. Pat. No. 5,220,335 discloses a planar microstrip Yagi-type antenna, having a driven element, reflector patches, and one or more director patches, all disposed on a dielectric substrate. Huang teaches that the dielectric constant of the substrate should be between 1.5 and 5. This requires the use of a low-loss, high-cost microwave substrate for the entire length of the antenna array. A substrate of this density will further increase the overall weight of the antenna by a substantial margin. A method of reducing the cost, weight and complexity of such a Yagi-type antenna is desired.

Kerr U.S. Pat. No. 4,118,706 teaches a microstrip-fed directional antenna that uses a rigid aluminum boom for support of the parasitic elements. The boom is then attached to a circuit board that contains the microstrip patch antenna and feed. The thickness of the aluminum boom precludes the use of low-cost manufacturing techniques, such as stamping. The use of a microstrip patch requires a low-loss, high-cost microwave substrate and additional labor to assemble the antenna array. Furthermore, because the microstrip patch circuit board lies in a plane perpendicular to the director array, the diameter of the antenna is increased, thereby precluding the use of small diameter radomes.

Therefore, there is a need for an improved design for a multi-element directional antenna that is manufactured using a simple and low-cost method, such as single or progressive die stamping.

SUMMARY OF THE INVENTION

The present invention consists of a novel, multi-element directional antenna and method of making the same. The antenna is a Yagi-type antenna that is formed in one piece from a sheet of conductive material using single and progressive die stamping techniques. The stamped antenna design forms a boom and an array of parasitic elements and a single driven element that radiate therefrom.

The driven element of the stamped antenna design is formed into a folded dipole, using basic folding techniques. This step can either be performed as a part of the initial stamping of the antenna or in a second process. A coaxial feed line is then attached across the gap that is formed by the open ends of the folded dipole driven element.

In a further embodiment of the present invention, the boom may be formed to extend both ends of the array, providing means of supporting the entire antenna within a protective radome.

Thus, a primary objective of the invention is to provide an improved multi-element directional antenna that can be formed in a simple, low-cost manner.

Another objective of the invention is to provide an improved multi-element Yagi-type directional antenna that is formed from a single metal sheet, using low-cost single or progressive die stamping techniques.

Another objective of the invention is to provide an improved, low-cost method of forming Yagi-Uda directional parasitic array antennas at microwave frequencies.

Another objective of the invention is to provide an improved, low-cost method of forming one-piece Yagi-Uda directional parasitic array antennas from a sheet of conductive material, wherein the dipole is formed in unitary construction with the antenna boom using basic element folding techniques.

These and other objectives will be apparent to those skilled in the art.

DESCRIPTION OF THE PREFERRED EMBODIMENT

Figure 1:
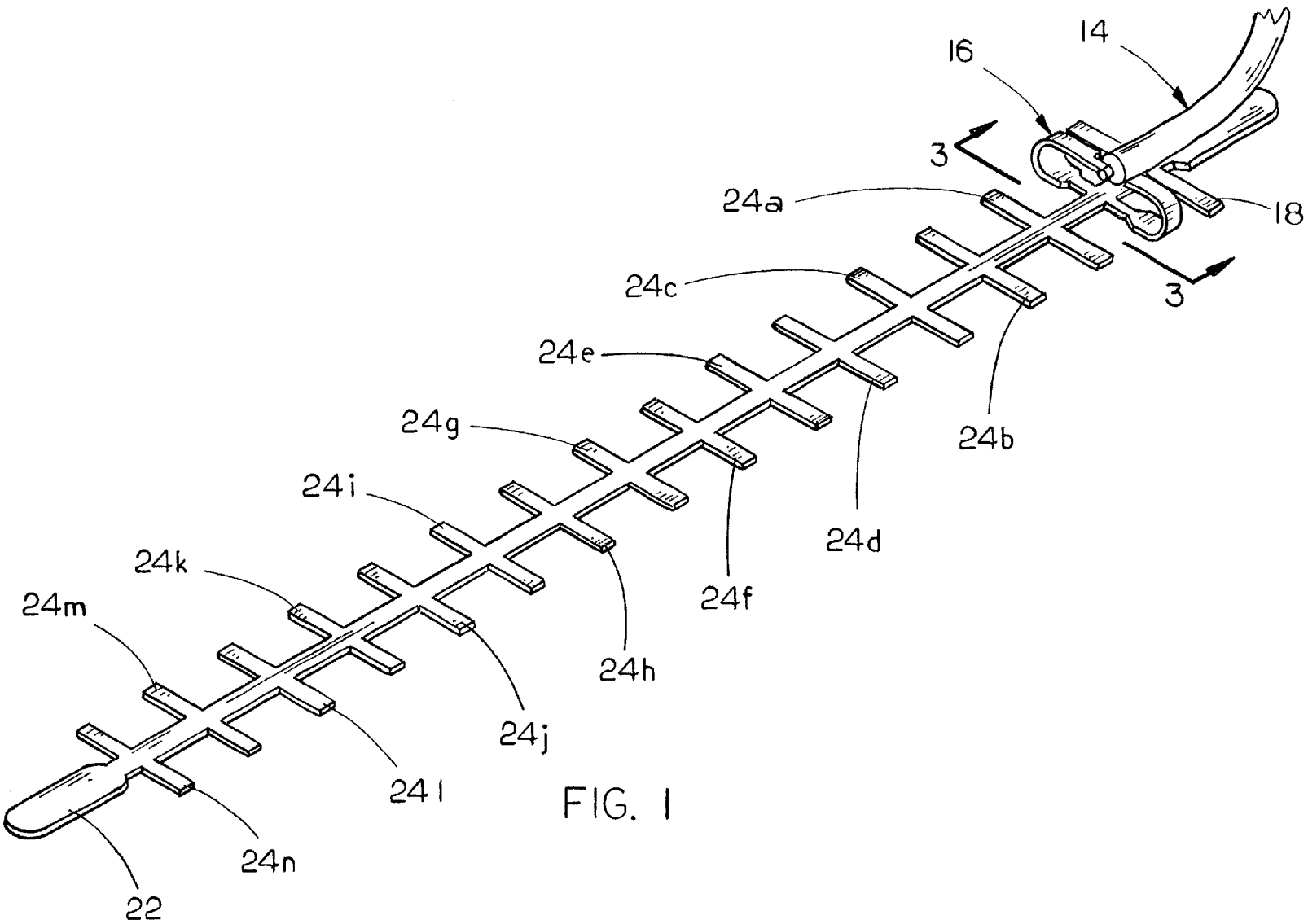
FIG. 1 is a front perspective view of the multi-element directional antenna of the present invention.
Figure 2:
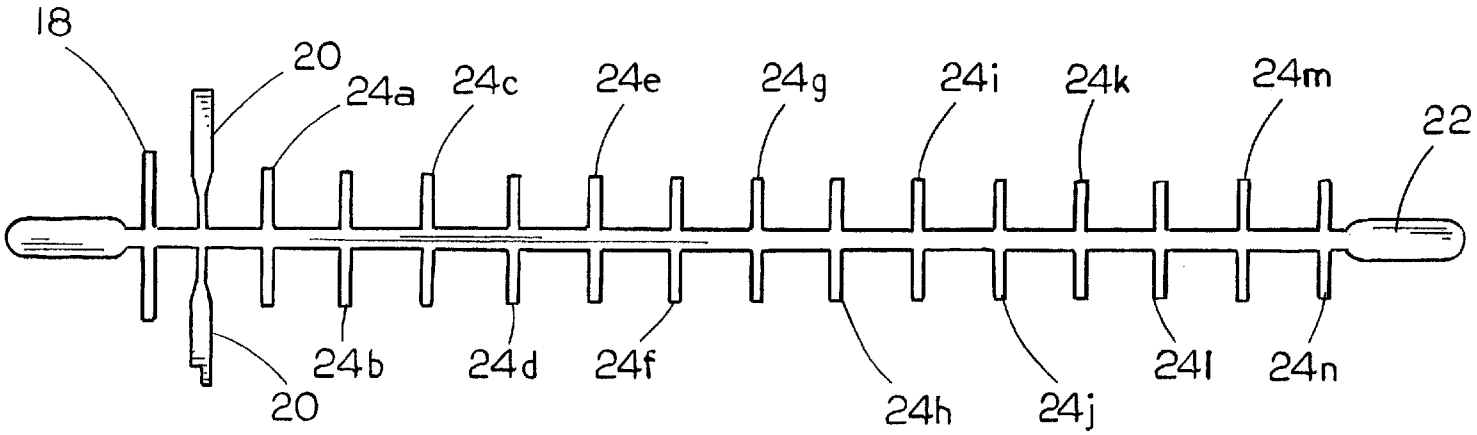
FIG. 2 is a top view of the multi-directional antenna array of the present invention.

Referring to FIGS. 1 and 2, the multi-element directional antenna 10 of the present invention is formed from a one-piece antenna array 12, with a coaxial feed line 14 attached across the gap of a folded dipole driven element 16. FIG. 2 shows the one-piece antenna array 14 after it has first been stamped from a sheet of conductive material, by single or progressive die stamping techniques, using a standard stamping die. The one-piece antenna array 12 consists of a reflector element 18, driven extended element 20, boom 22 and a plurality of parasitic elements 24.

In a preferred embodiment of the present invention, the one-piece antenna array 12 is made from 0.032-inch thick phosphor-bronze metal sheet. Other conductive materials may also be used, including copper, brass and aluminum. The thickness of the conductive material may be varied up to a maximum thickness of approximately one-tenth of one wavelength.

The antenna array 12 comprises a plurality of parasitic elements 24 which are electrically and operatively connected to one another by the boom 22. The elements 24 are spaced from, and run parallel to, one another while extending perpendicular to the boom 22. The length of each parasitic element 24 is symmetrical about the boom 22 centerline. The length of the parasitic elements 24 and the spacing between each such element 24 are chosen in accordance with equations that are well-known in the art so as to provide an antenna array that has desired end-fire characteristics and directivity. For example, to provide a frequency range of 5.725–5.825 GHz, the preferred length and spacing of the parasitic elements 24 of the present invention have been selected as follows:

| ELEMENT | DISTANCE (inches) | LENGTH (inches) |
|---|---|---|
| 18 | 0.000 | 1.058 |
| 24a | 0.610 | 0.892 |
| 24b | 1.034 | 0.860 |
| 24c | 1.485 | 0.828 |
| 24d | 1.962 | 0.804 |
| 24e | 2.413 | 0.788 |
| 24f | 2.864 | 0.772 |
| 24g | 3.315 | 0.772 |
| 24h | 3.765 | 0.772 |
| 24i | 4.216 | 0.752 |
| 24j | 4.667 | 0.764 |
| 24k | 5.117 | 0.744 |
| 24l | 5.568 | 0.744 |
| 24m | 6.019 | 0.796 |
| 24n | 6.470 | 0.744 |

Figure 3:
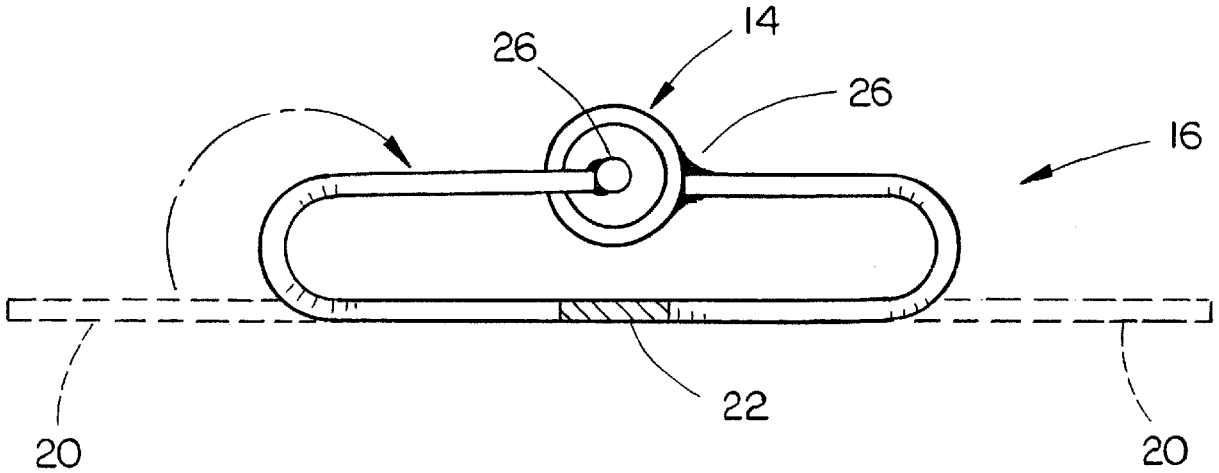
FIG. 3 is a front view of the folded dipole driven element of the multi-element directional antenna.

With the basic antenna array 12 stamped from the conductive material, the driven element 20 is formed into a folded dipole 16 using basic folding techniques. In doing so, the opposite ends of the driven element 20 are folded, proximal the boom 22 and each end of the driven element 16, outward at a generally 90° angle. Both ends of driven element 20 are then folded inward at a generally 90° angle, such that the ends of driven element 20 are closely adjacent one another, directly above the boom 22. FIG. 3 depicts the direction that driven element 20 is folded to form the folded dipole element 16. This step can either be performed as a part of the initial stamping of the antenna array 12 or in a second step.

Figure 4:
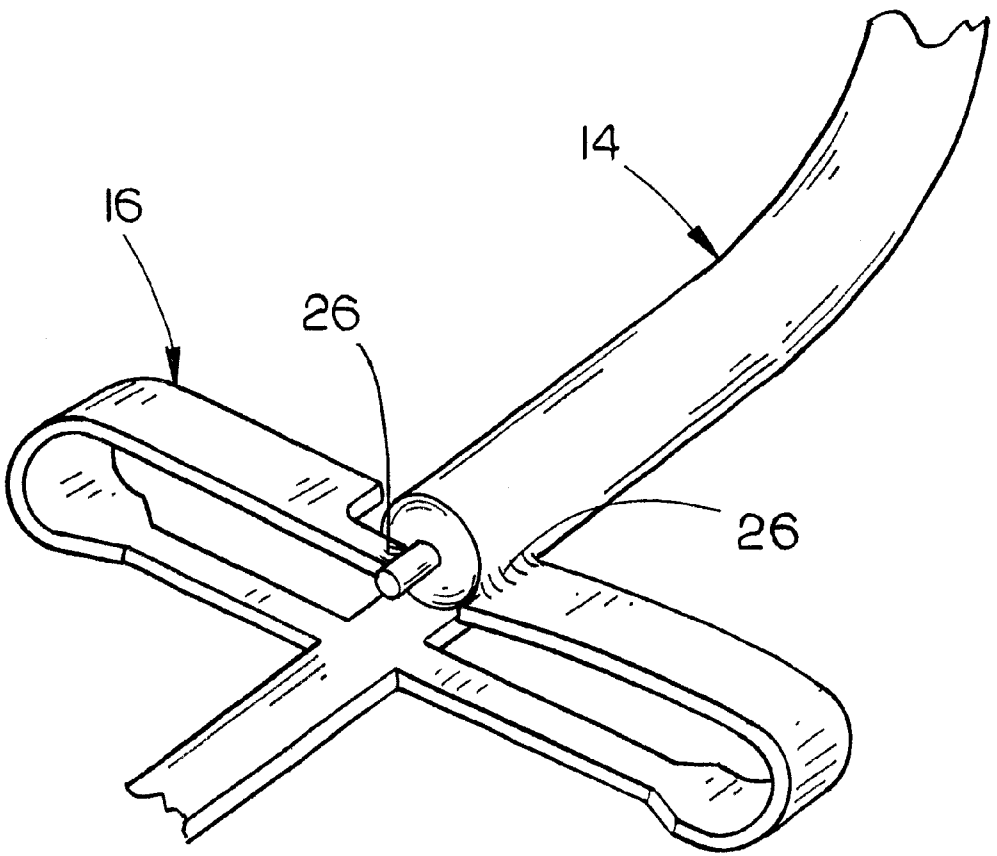
FIG. 4 is a rear perspective view of the folded dipole driven element of the multi-element directional antenna.

A coaxial feed line 14 is then attached across the gap that is formed by the open ends of the folded dipole driven element 16. If the antenna array 12 is stamped from a copper alloy, the coaxial feed line 14 may be operatively connected to the folded dipole driven element 16 using solder 26, as shown by FIG. 4. If aluminum alloys are used, the coaxial feed line 14 may be attached to the folded dipole driven element 16 by mechanical means, such as with screws or rivets.

In another embodiment of the present invention, the boom 22 may be formed such that the length between the opposite ends thereof is extended to provide a means of operatively coupling a protective radome over the entire multi-element directional antenna 10.

In the drawings and in the specification, there has been set forth preferred embodiments of the invention and although specific items are employed, these are used in a generic and descriptive sense only and not for purposes of limitation. Changes in the form and proportion of parts, as well as in the substitution of equivalents, are contemplated as circumstances may suggest or render expedient without departing from the spirit or scope of the invention as further defined in the following claims.

Thus it can be seen that the invention accomplishes at least all of its stated objectives.

I claim:

1. A one-piece multi-element directional antenna, comprising:

an elongated boom having forward and rearward ends;

said boom having an extended element having opposite ends, proximate the rearward end of said boom;

said boom having a plurality of parasitic elements extending substantially perpendicular therefrom in spaced relation to one another;

said extended element being folded upon itself to form a folded dipole driven element; and said boom, extended element, and said parasitic elements being of one-piece construction, formed from a sheet of conductive material.

2. The one-piece multi-element directional antenna of claim 1 further comprising a coaxial feed line operatively connected to said folded dipole driven element.

3. The one-piece multi-element directional antenna of claim 2 further comprising a radome coupled to said forward and rearward ends of said boom.

4. A method of forming a multi-element directional antenna, comprising the steps of:

stamping a one-piece antenna array from a sheet of conductive material; said antenna array comprising a boom, an extended element, and a plurality of parasitic elements; said extended element having opposite end portions that are folded to form a folded dipole driven element; and operatively connecting a coaxial feed line to said antenna.

5. The method of claim 4 further comprising the step of coupling a radome to said boom.

6. A method of forming a Yagi-Uda antenna, comprising the steps of:

stamping a one-piece antenna array from a sheet of conductive material; said antenna array comprising a boom, a driven extended element having opposite ends, and a plurality of non-driven parasitic elements; and folding the opposite ends of said extended element to form a folded dipole driven element.

7. The method of claim 6 further comprising the step of operatively connecting a coaxial feed line to said folded dipole driven element.

8.The method of claim 7 further comprising the step of operatively coupling a radome to said boom.

* * * * *